US006817919B1

(12) United States Patent
Sato et al.

(10) Patent No.: US 6,817,919 B1
(45) Date of Patent: Nov. 16, 2004

(54) METHOD AND APPARATUS FOR MANUFACTURING A FRAME WORK FOR SHADOW MASK

(75) Inventors: Kenichi Sato, Osaka (JP); Taizou Takeuchi, Osaka (JP); Kounosuke Okumura, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 889 days.

(21) Appl. No.: 09/640,424

(22) Filed: Aug. 17, 2000

(30) Foreign Application Priority Data

Sep. 3, 1999 (JP) ..... 11-250106

(51) Int. Cl.[7] ..... H01J 9/00

(52) U.S. Cl. ..... 445/30; 445/36; 445/37; 445/47; 313/407

(58) Field of Search ..... 445/30, 34, 36, 445/37, 45, 47, 68; 313/407

(56) References Cited

U.S. PATENT DOCUMENTS 4,291,253 A * 9/1981 Ohkoshi et al. ..... 313/403
4,495,437 A * 1/1985 Kume et al. ..... 313/407
5,550,428 A * 8/1996 Kume et al. ..... 313/407
5,644,192 A * 7/1997 Ragland, Jr. ..... 313/407
5,898,259 A 4/1999 Reyal ..... 313/407
6,479,925 B1 * 11/2002 Kim ..... 313/402

FOREIGN PATENT DOCUMENTS

| | | |
|---|---|---|
| DE | 197 23 306 | 12/1998 |
| JP | 4-144027 | 5/1992 |
| JP | 11-204027 | 7/1999 |

* cited by examiner

*Primary Examiner*—Nimeshkumar D. Patel
*Assistant Examiner*—Mariceli Santiago
(74) *Attorney, Agent, or Firm*—Merchant & Gould P.C.

(57) ABSTRACT

After assembling a framework in an approximately rectangular form, a basis plane is formed by grinding a bottom surface of the framework. Then, ends of two opposing sides of the framework on a side opposite to the basis plane are cut in a predetermined shape by shearing. The grinding can be carried out by placing the framework on a grinding surface that is running, while applying substantially no pressurizing force other than the self weight of the framework. According to this method, precision of forming end faces of a framework on which a shadow mask is mounted can be improved. Also, working time can be shortened.

7 Claims, 6 Drawing Sheets

METHOD AND APPARATUS FOR MANUFACTURING A FRAME WORK FOR SHADOW MASK

FIELD OF THE INVENTION

The present invention relates to methods and apparatuses for manufacturing a framework for a shadow mask used in cathode ray tubes. In particular, the present invention relates to methods and apparatuses for forming end faces on which a shadow mask is mounted, in which when ends of two opposing side frames positioned in parallel of a rectangular framework are formed into, for example, a curved shape, and a shadow mask is stretched on the end faces, a cylindrical surface formed by the shadow mask can have cylindricity and curvature with high precision.

BACKGROUND OF THE INVENTION

In general, a shadow mask is mounted in a cathode ray tube by stretching it on a framework, which is assembled into a rectangular shape by means of welding etc. Usually, the framework is constructed by fixing a pair of long-side frames arranged horizontally to upper and lower ends of a pair of short-side frames, which are arranged vertically at a distance. Then, a shadow mask is stretched on screen side faces of the long-side frames.

The end faces of the long-side frames on which a shadow mask is stretched are usually formed into a predetermined curved shape (e.g. a circular arc shape with a radius R) so that their center portions become convex to the screen side.

Conventionally, the formation of curved end faces has been carried out by cutting or grinding after assembling the short-side and long-side frames into a rectangular form.

In the above-mentioned method, it is necessary to fix firmly the rectangular framework to be worked on. However, when the framework is fixed firmly, a deformation is generated in the rectangular framework. Furthermore, a rectangular framework bonded by welding often has a little distortion, and when it is fixed firmly in a working apparatus under this condition, a deformation resulting from the distortion is generated. Any of the above-mentioned deformations will be released when the framework is released from fixation after being worked on. Thus, no matter how precisely curved end faces are formed on a working apparatus, when the framework is released from fixation after being worked on, so-called return distortion is generated in a worked portion. Due to the return distortion, the precision of the cylindricity and curvature of a shadow mask surface is difficult to be increased. Furthermore, in order to prevent return distortion, there is a method of placing the rectangular framework precisely by a three-point supporting method. However, a high-level skill is required for the fixing method, and also productivity is inferior.

In the cutting or grinding process, when the strength of fixing the rectangular framework to a working apparatus is decreased so as to prevent the above-mentioned generation of return distortion, it is required to carry out the working under a light load, so that it takes a long working time.

Moreover, labor is required for setting and removing the rectangular framework to and from a working apparatus, and it is extremely inefficient.

SUMMARY OF THE INVENTION

It is an object of the present invention to provide methods and apparatuses for manufacturing a framework for a shadow mask that solve the above-mentioned conventional problems, in which precision is increased for forming end faces of a rectangular framework on which a shadow mask is mounted, working time is shortened considerably, operations of setting and removing the rectangular framework to and from a working apparatus are simplified, and working precision and production efficiency are satisfactory.

In order to accomplish the above object, the present invention provides methods and apparatuses as follows:

A first method for manufacturing a framework for a shadow mask according to the present invention includes cutting ends on a screen side of frames constituting two opposing sides of a framework in a predetermined shape by shearing, thereby obtaining end faces on which a shadow mask is stretched, wherein the framework is assembled in an approximately rectangular form.

A second method for manufacturing a framework for a shadow mask according to the present invention includes: assembling a framework in an approximately rectangular form; grinding a bottom face of the framework, thereby forming a basis plane; and cutting ends on a side opposite to the basis plane of frames constituting two opposing sides of the framework in a predetermined shape by shearing, thereby obtaining end faces on which a shadow mask is stretched.

According to the above first and second methods, the end faces on which a shadow mask is stretched are formed by shearing, and the shearing is carried out in only about several seconds. Thus, working time can be shortened considerably, and productivity of a framework for a shadow mask is improved significantly.

In the above second method, it is preferable that, when grinding the bottom face of the framework, the framework is placed on a grinding surface that is running, and the bottom face of the framework is ground while restricting movement of the framework in the running direction of the grinding surface. According to such a construction, in the subsequent shearing process, a basis plane for press-fixing the framework to an apparatus can be obtained at the bottom face speedily.

In the above, it is preferable that the bottom face of the framework is ground while substantially no pressurizing force other than the self-weight of the framework is applied in the direction perpendicular to the grinding surface. Accordingly, no external force other than the self-weight acts on the framework when forming the basis plane. Thus, the so-called return distortion is not generated after the grinding, and a basis plane having a very high flatness can be obtained.

In the above second method, it is preferable that when the shearing is carried out, the framework is fixed using the basis plane as an application surface. Accordingly, the so-called return distortion is not generated after the shearing. Furthermore, precision of the distance between the basis plane and the end faces formed by shearing can be increased, and also the generation of a tilt of the end faces with respect to the basis plane can be prevented.

In the above second method, it is preferable that a basis point for positioning is provided at one point in the framework, and that when ends of the frames constituting two opposing sides are sheared respectively, the positioning of each of the frames in a longitudinal direction is carried out using the basis point. Accordingly, the longitudinal positions of the two end faces formed on the two opposing sides can be allowed to coincide, so that a cylindrical surface formed by a shadow mask stretched on the end faces that are formed into, for example, a curved shape can realize very high cylindricity and accurate curvature.

A grinding apparatus for a framework for a shadow mask according to the present invention includes: a grinding surface that is running; and a stopper for preventing a framework from moving in a running direction of the grinding surface when the framework is placed on the grinding surface, wherein the framework is assembled in an approximately rectangular form. According to this apparatus, a basis plane for press-fixing the framework to an apparatus in the subsequent shearing process can be obtained speedily.

In the grinding apparatus, it is preferable that substantially no pressurizing force other than the self-weight of the framework is applied in the direction perpendicular to the grinding surface. Accordingly, when forming the basis plane, no external force other than the self-weight acts on the framework. Thus, the so-called return distortion is not generated after the grinding, and a basis plane with a very high flatness can be obtained.

Furthermore, in the grinding apparatus, it is preferable that the grinding surface is a circulating grinding belt, with the grinding belt sliding on a flat-plate shaped bed, and the framework is placed so as to face the bed. Accordingly, a basis plane with a high flatness can be obtained with a simple structure.

A shearing apparatus for a framework for a shadow mask according to the present invention includes: a die for cutting faces of frames constituting two opposing sides of a framework in a predetermined shape by shearing, wherein the framework is assembled in an approximately rectangular form and has a bottom face as a basis plane, and the faces are on a side opposite to the basis plane; a frame position controlling unit for positioning each of the frames in a longitudinal direction; a base on which the basis plane is applied; and a clamper for press-fixing the framework on the base. According to this apparatus, the end faces on which a shadow mask is stretched can be formed by shearing, so that working time can be shortened considerably, and productivity is improved significantly. Furthermore, when shearing is carried out, because the framework is press-fixed on the base at the basis plane, the framework is not deformed when it is press-fixed. Accordingly, the so-called return distortion is not generated when the framework is released from the press-fixing after the shearing, and end faces on which a shadow mask is mounted can be formed with high precision.

In the shearing apparatus, it is preferable that when the frames constituting two opposing sides are sheared respectively, positioning of each of the frames is carried out by the frame position controlling unit using a common basis point provided in the framework. Accordingly, longitudinal positions of the two end faces formed on the two opposing sides can coincide, so that a cylindrical surface formed by a shadow mask stretched on the end faces that are formed into, for example, a curved shape can realize very high cylindricity and accurate curvature.

BRIEF DESCRIPTION OF THE DRAWINGS

FIG. 2(A) is a bottom view; FIG. 2(B) is a left side view; and FIG. 2(C) is a front view.

PREFERRED EMBODIMENTS OF THE INVENTION

In the following, embodiments of the present invention are described referring to FIGS. 1 to 6.

Figure 1:
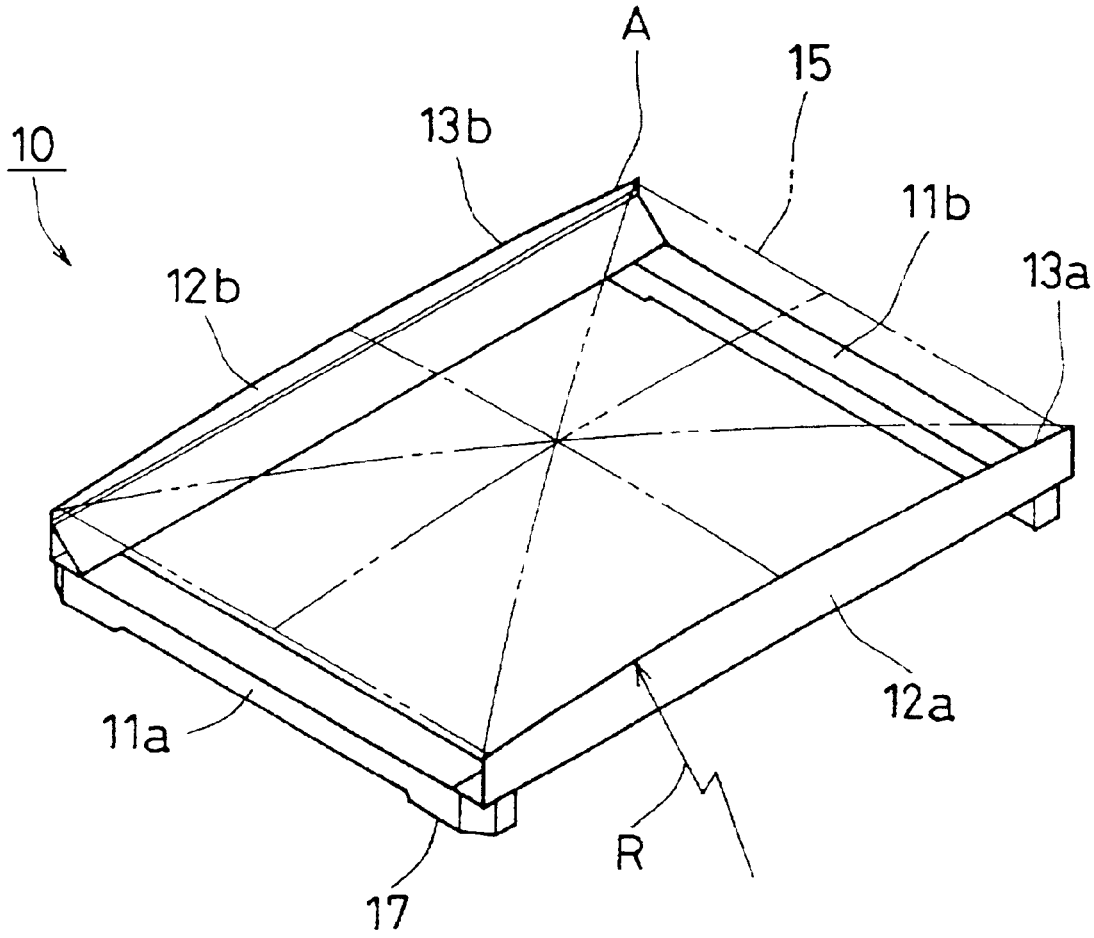
FIG. 1 is a schematic perspective view showing a configuration of a framework for a shadow mask obtained according to the present invention.
Figure 2:
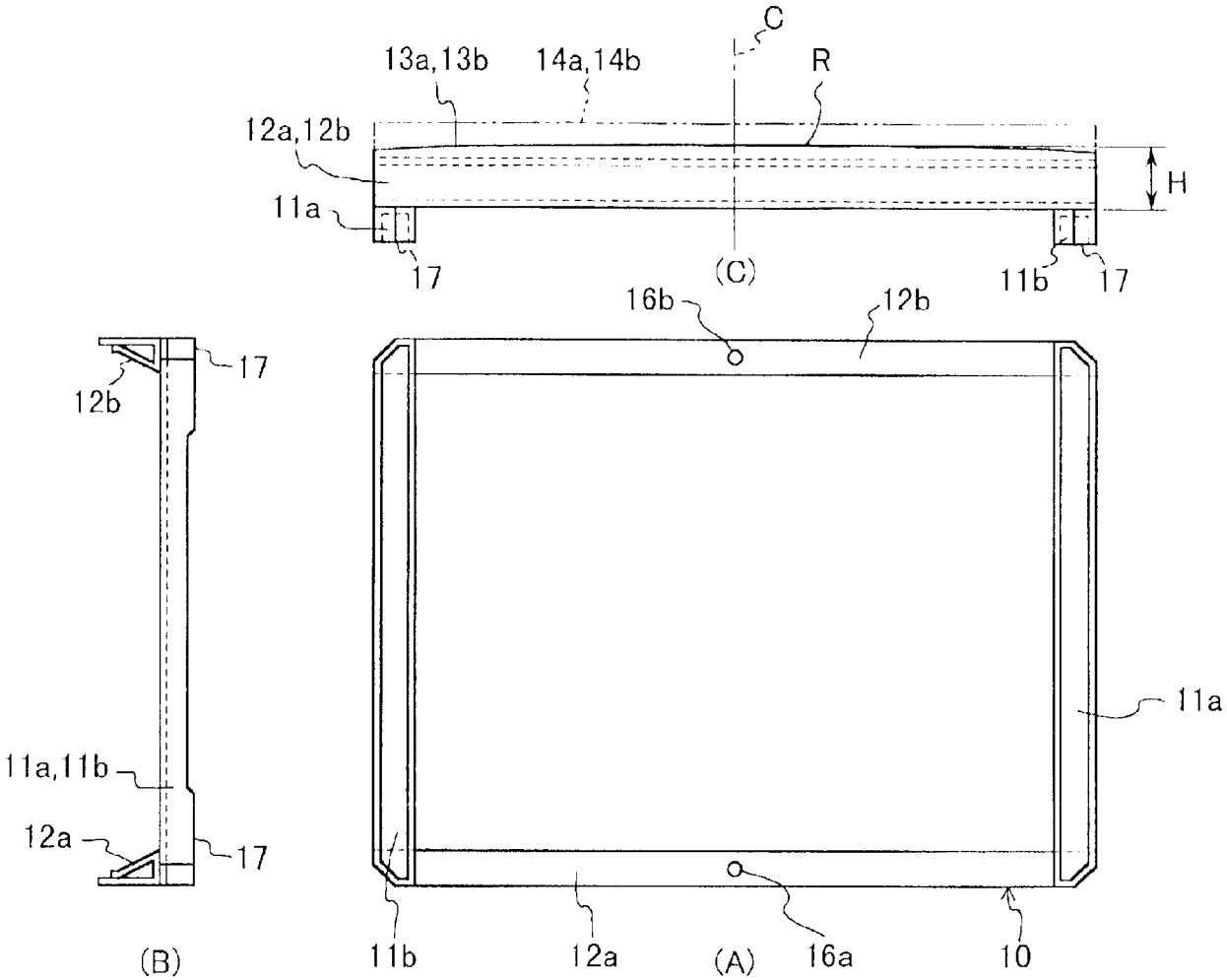
FIG. 2 is a diagram showing a configuration of a framework for a shadow mask obtained according to the present invention.

FIG. 1 is a schematic perspective view showing a configuration of a framework for a shadow mask. FIG. 2 also shows a configuration of a framework for a shadow mask: FIG. 2(A) is a bottom view; FIG. 2(B) is a left side view; and FIG. 2(C) is a front view.

As shown in the drawings, a framework 10 for a shadow mask (a rectangular framework; hereinafter also may simply referred to as "framework") comprises a pair of short-side frames 11*a* and 11*b* arranged in parallel, and a pair of long-side frames 12*a* and 12*b* arranged in parallel, in which ends of the short-side frames 11*a* and 11*b* are bonded to ends of the long-side frames 12*a* and 12*b* by welding. The short-side frames 11*a* and 11*b* are constructed by folding a metal flat plate in an approximately open box shape in cross section. The long-side frames 12*a* and 12*b* are constructed by folding a metal flat plate in an approximately triangular shape in cross section. The metal flat plates of the long-side frames 12*a* and 12*b* are extended to the side opposite to the short-side frames 11*a* and 11*b* (screen side in a cathode ray tube), and a shadow mask is stretched on end faces 13*a* and 13*b*, which are ends of the metal flat plate. The end faces 13*a* and 13*b* are formed into a shape of a circular arc curve having a predetermined radius R of curvature, so that they are convex to the side opposite to the short-side frames 11*a* and 11*b* (screen side in a cathode ray tube).

In this embodiment, the cylindricity of a cylindrical surface 15 (shadow mask surface) formed by the opposing end faces 13*a* and 13*b* positioned in parallel is not more than 0.05 mm in the degree of torsion, and cylindricities of end faces 13*a* and 13*b* are respectively not more than ±0.05 mm. In this embodiment, the cylindricities of the end faces 13*a* and 13*b* are different from the cylindricity of the cylindrical surface 15 (shadow mask surface) formed by the end faces 13*a* and 13*b*. Even if the end faces 13*a* and 13*b* are perfectly cylindrical surfaces, for example, when the center axes of both cylindrical surfaces do not coincide, the surface of the shadow mask stretched on the end faces does not become perfectly cylindrical. In this embodiment, by using the method and apparatuses of the present invention described below, the end faces 13*a* and 13*b* can be formed into a curved shape with high precision within the above range of tolerance.

In the following, the method and the apparatuses of this embodiment are described.

First, short-side frames 11*a* and 11*b* and long-side frames 12*a* and 12*b* that are obtained by pressing metal flat plates are assembled into a rectangular form and are welded integrally as shown in FIGS. 1 and 2. Then, the integrated assembly is annealed to remove intrinsic stresses due to the pressing and welding. At this time, end faces 13*a* and 13*b* of the long-side frames 12*a* and 12*b* are not formed yet, and as shown by alternate long and two short dashes lines 14*a* and

14*b* in FIG. 2(C), the metal flat plates extend to the side opposite to the short-side frames 11*a* and 11*b*.

Figure 3:
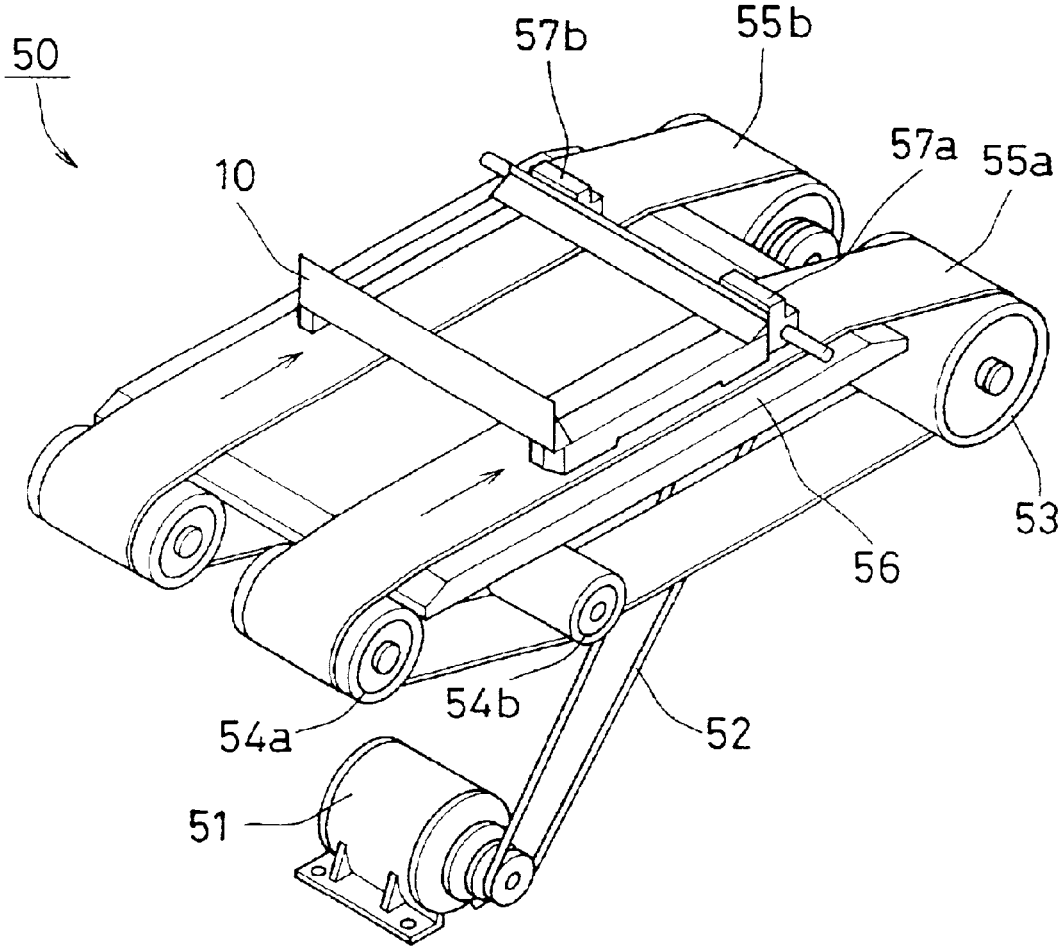
FIG. 3 is a schematic diagram showing a condition in which a basis plane of a rectangular framework is ground using a grinding apparatus of the present invention.

Next, in the framework thus obtained, bottom faces (faces of the short-side frames on the side not bonded to the long-side frames), which are to be a basis plane, are ground using a grinding apparatus 50 of a belt grinder system shown in FIG. 3. The basis plane 17 obtained by the grinding becomes a basis when fixing the framework in a shearing apparatus in the subsequent shearing process.

In FIG. 3, numeral 51 denotes a driving motor; 52 denotes a V-belt for transmitting the power of the driving motor to a driving roller 53; 54*a* and 54*b* denote trailing rollers; 55*a* and 55*b* denote two belt-shaped grinding papers that are run circularly by the driving roller 53 and the trailing rollers 54*a* and 54*b*; 56 denotes a bed having a top surface precisely manufactured with a flatness precision of not more than one hundredth millimeter; and 57*a* and 57*b* denote a pair of receiving metallic parts as stoppers.

A framework 10 is placed so that the basis plane 17 of the short-side frames 11*a* and 11*b* respectively corresponds to the grinding papers 55*a* and 55*b* that are running at a high speed. The two grinding papers 55*a* and 55*b* slide closely on the common bed 56, and the framework 10 is placed so as to face the bed 56. Thus, even if the framework 10 is placed, the surfaces of the grinding papers 55*a* and 55*b* do not sink and keep flat surfaces with a precision as high as that of the bed 56. Movement of the framework 10 in the running direction of the grinding papers 55*a* and 55*b* is stopped by the receiving metallic parts 57*a* and 57*b*.

The framework 10 in which intrinsic stresses have been removed through annealing after the welding has generated a little distortion in flatness. However, the bottom faces of the framework 10 are placed on the two grinding papers 55*a* and 55*b* respectively, and the bottom faces are ground under a load of only the self-weight of the framework 10 in a free condition, without using any fixing measure except for restricting movement in the running direction of the grinding papers 55*a* and 55*b*. Thus, the framework 10 is not distorted during the grinding, and a basis plane 17 with a high flatness precision can be obtained. According to this method, the so-called return distortion is not generated, and a basis plane that is ground precisely with a flatness precision not more than one hundredth millimeter can be formed at the bottom faces of the framework 10. When such a basis plane with high precision can be formed, even if the basis plane is applied on an apparatus to be clamped with a necessary fixing force in the subsequent process of forming curved end faces, the framework 10 is not distorted, and the so-called return distortion is not generated after the working.

Figure 4:
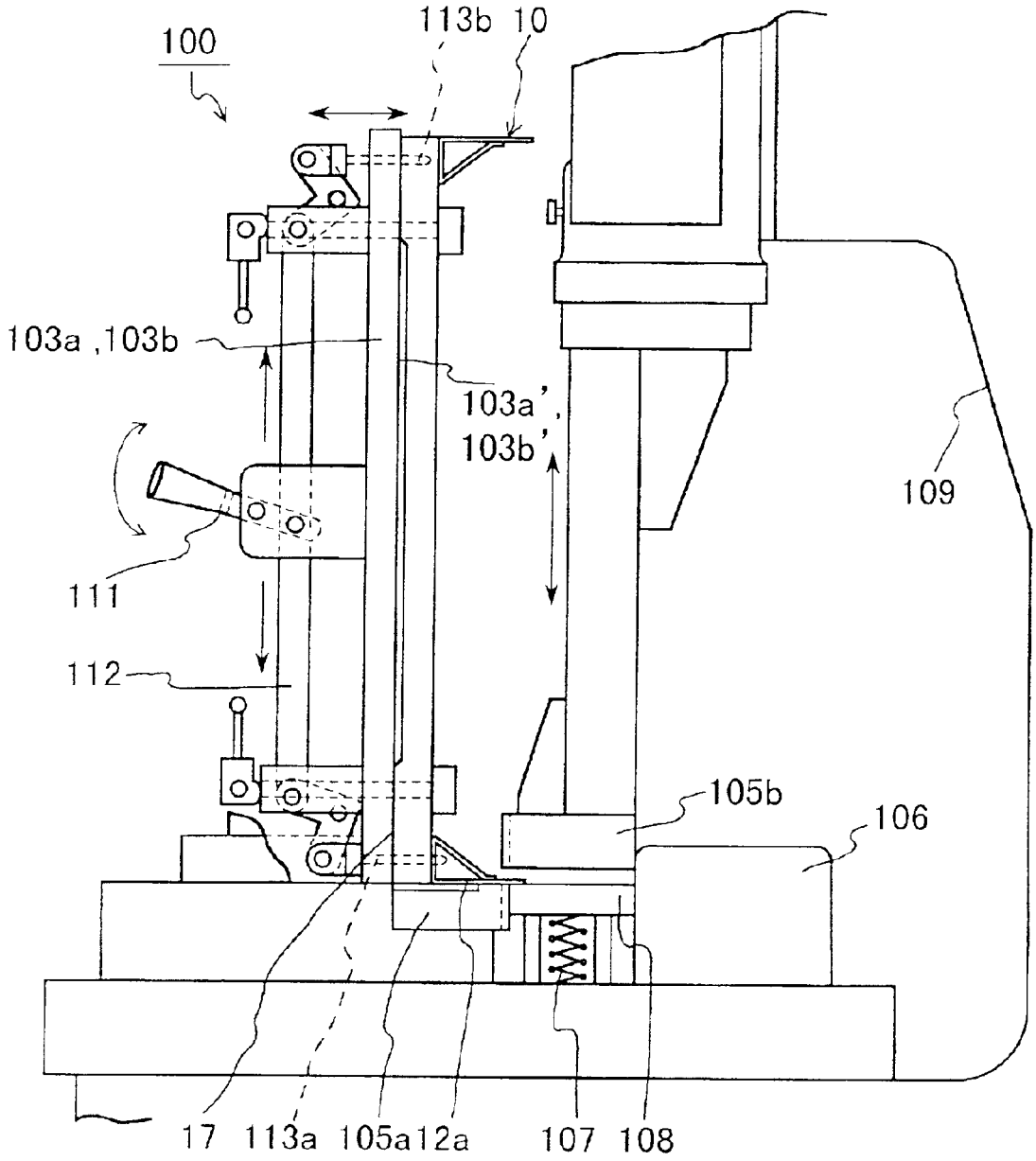
FIG. 4 is a side view showing a condition in which a rectangular framework is set in a shearing apparatus of the present invention.
Figure 5:
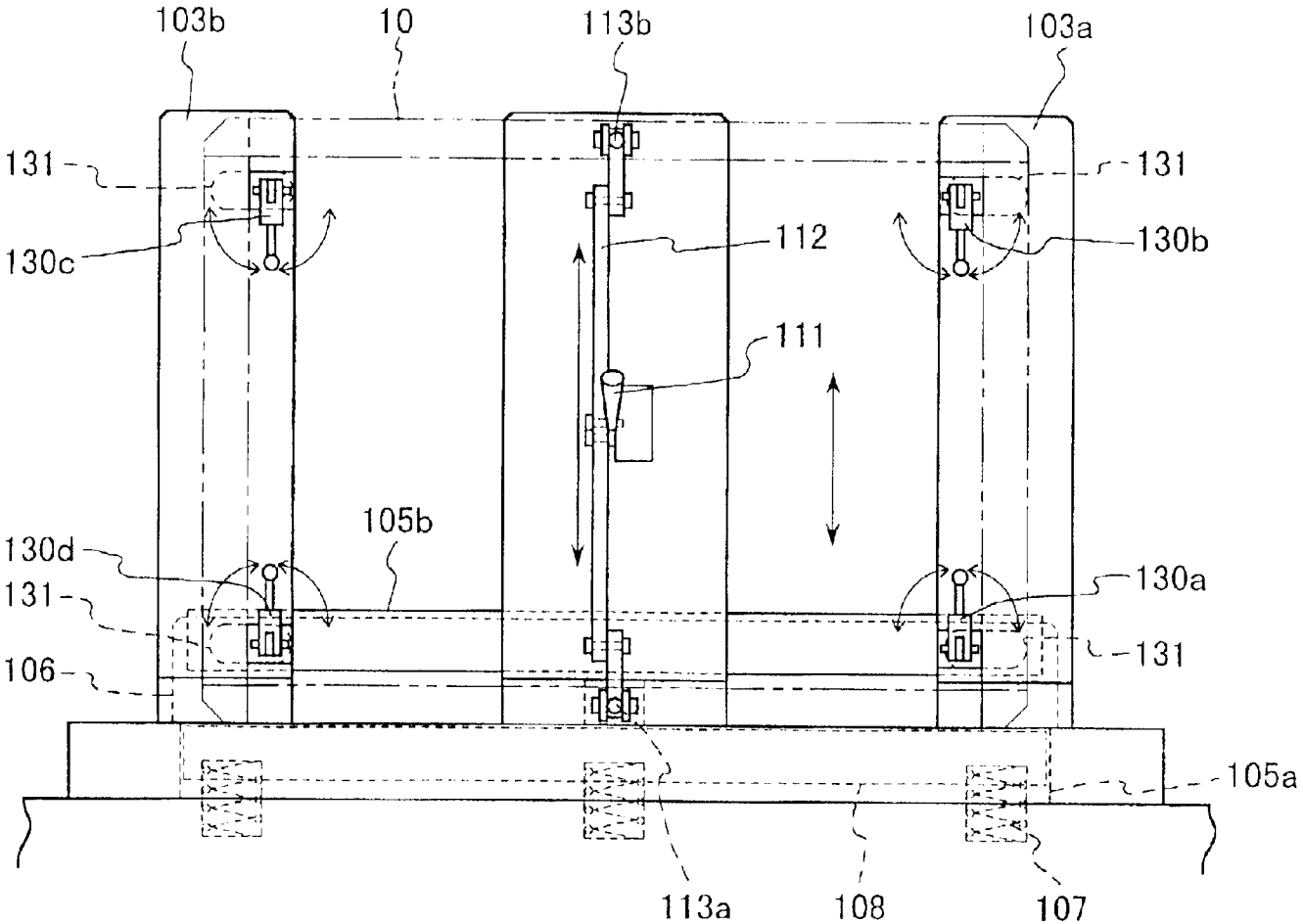
FIG. 5 is a front view of a shearing apparatus of the present invention, which is viewed from the side of a bottom face (a basis plane) of a rectangular framework.
Figure 6:
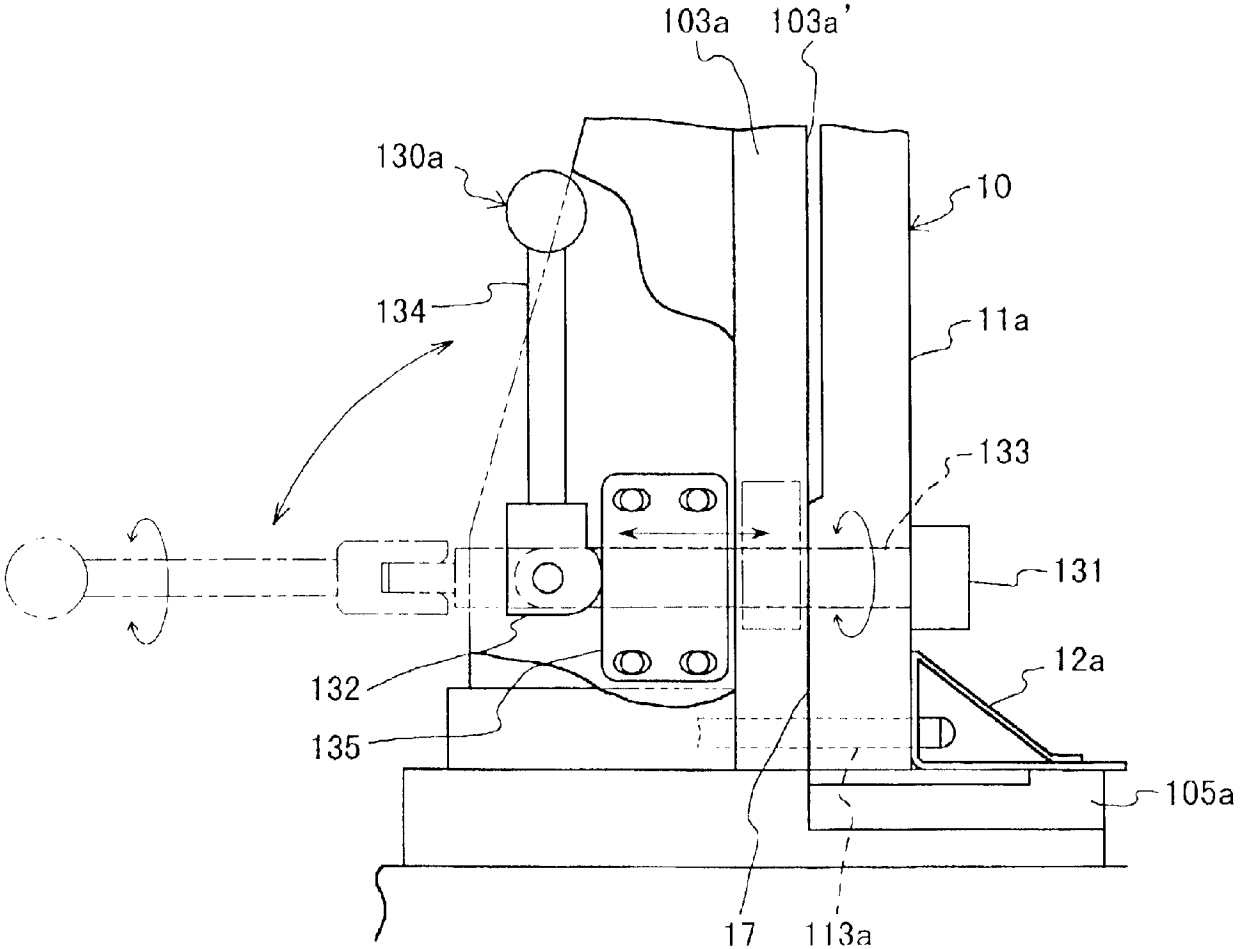
FIG. 6 is a partially enlarged side view showing a configuration of a clamper in a shearing apparatus of the present invention.

In the framework 10 in which the basis plane 17 is formed, linear ends 14*a* and 14*b* of the long-side frames before being worked as shown in FIG. 2(C), which are indicated by an alternate long and two short dashes line, are cut by shearing using a shearing apparatus 100 shown in FIGS. 4 to 6, and are formed into a curved shape.

FIG. 4 is a side view showing a condition in which the framework 10 is set in the shearing apparatus 100. FIG. 5 is a front view of the shearing apparatus 100, which is viewed from the side of a bottom face (basis plane) of the framework 10. In FIG. 5, the framework 10 is indicated by an alternate long and two short dashes line for simplification.

In FIG. 4, a lower die 105*a* and an upper die 105*b* function as shearing edges by both dies biting each other. The shearing edge has been manufactured to have a shape of a circular arc curve so that the linear upper ends 14*a* and 14*b* of the long-side frames can be sheared with a desired radius of curvature R. The upper die 105*b* is fixed to a column 109 of the pressing apparatus 100 so as to be movable up and down. The lower die 105*a* is fixed to a base. When the upper die 105*b* descends to carry out shearing, it is moved while sliding on a surface of back-up 106 at its back face. Accordingly, escape of the upper die 105*b* is prevented, and draught clearance between the upper die 105*b* and the lower die 105*a* is kept constant.

A pad 108 supported with a spring 107 is arranged between the lower die 105*a* and the back-up 106 so that the upper face of the pad 108 is in the same plane as the upper face of the lower die 105*a*. Accordingly, the shearing can be carried out while sandwiching a cut-side material between the upper die 105*b* and the pad 108, so that a material on the cut side of the end of the frame can be prevented from escaping in the shearing.

The framework 10 is set in the shearing apparatus 100 as follows:

In a condition in which the long-side frames 12*a* and 12*b* of the framework 10 are positioned horizontally and the short-side frames 11*a* and 11*b* are positioned vertically, the long-side frame 12*a* on the lower side is placed on the lower die 105*a*, and the basis plane 17 as bottom faces of the framework 10 is placed against faces 103*a*' and 103*b*' of bases 103*a* and 103*b*, which are positioned vertically in the shearing apparatus 100.

The bases 103*a* and 103*b* provided at right and left in a pair have faces 103*a*' and 103*b*' respectively against which the framework is applied, which maintain predetermined precisions so as to form an identical plane as well as to cross at right angles the center line of a circular arc of the upper and lower dies 105*a* and 105*b* with a radius R of curvature. Accordingly, the framework 10 can be fixed on the bases 103*a* and 103*b* with dampers at four corners, which are described below, without having a distortion. Also, when linear ends 14*a* and 14*b* of the long-side frames 12*a* and 12*b* of the framework 10 before a working are sheared to form a shape of a circular arc, size precision of the distance H (see FIG. 2(C)) between the top of the circular arcs of the obtained end faces 13*a* and 13*b* and the basis plane 17 as bottom faces of the framework 10 can be maintained. Furthermore, the center lines C (see FIG. 2(C)) of the circular arcs of the end faces 13*a* and 13*b* can cross the basis plane 17 at right angles. Furthermore, uniform precision of the distances between a cylindrical surface formed by the end faces 13*a* and 13*b* and the basis plane 17 can be maintained.

Next, in the framework 10, the position of the framework 10 in the long-side direction is controlled by a frame position controlling unit. The frame position controlling unit comprises: a handle 111; a linkage 112 which moves up-and-down linked with the operation of the handle 111; and two position-controlling pins 113*a* and 113*b*, which are provided as a pair in the up-and-down direction, and are held for horizontal movement linked with the up-and-down movement of the linkage 112. The linkage 112 has a yoke-type structure, in which, by operating the handle 111, two position-controlling pins 113*a* and 113*b* are inserted alternatively in the center holes 16*a* and 16*b* (see FIG. 2(A)), which function as basis points for positioning and are provided at the centers of the long-side frames 12*a* and 12*b* of the framework 10 in the longitudinal direction. The linkage 112 is arranged so that the two pins 113*a* and 113*b* are not inserted in the center holes 16*a* and 16*b* simultaneously.

Using the frame position controlling unit that is configured as described above, the lower position-controlling pin 113*a* is inserted in the center hole 16*a* of the long-side frame 12*a* (see FIG. 2(A)) by operating the handle 111.

In this state, the framework 10 is fixed closely on the bases 103*a* and 103*b* with dampers 130*a*, 130*b*, 130*c* and 130*d* provided at four corners.

FIG. 6 shows an enlarged side view of the damper 130*a* at a right lower portion in FIG. 5. The dampers provided at four corners have the same basic construction as the damper 130*a* in FIG. 6.

Each damper comprises: a clamping hook 131 for press-fixing the short-side frame 11*a* (or 11*b*) on the base 103*a* (or 103*b*), which is mounted at a tip of the clamper; a clamping cam 132 for generating a force for fixing the framework 10; a round-bar shaped connecting pole 133 for connecting the clamping hook 131 and the clamping cam 132 and for moving the clamping hook 131 horizontally as well as rotating it around the axis of the connecting pole 133; a handle 134 that is fixed to the clamping cam 132 for operating the clamping cam 132 and for moving horizontally and rotating the clamping hook 131; and a cam pedestal 135 for keeping the connecting pole 133 to be horizontally movable as well as rotatable and for generating a clamping force by making contact with the clamping cam 132. The cam pedestal 135 is fixed on the base 103*a* (or 130*b*) with a screw, after adjusting the clamping force of the clamping cam 132, with a long hole parallel to the axial direction of the connecting pole 133. The clamping hook 131 is pole-shaped (e.g. a square pole) and is connected to the connecting pole 133 at a position away from the center to one side in the longitudinal direction of the is clamping hook 131.

The procedure for operating the damper is as follows: Before setting the framework 10, the clamping hook 131 is put in a condition in which it is recessed below the faces 103*a*' and 103*b*' of the bases 103*a* and 103*b* (a state as indicated by an alternate long and two short dashes line in FIG. 6), and the framework 10 is inserted between the bases 103*a* and 103*b* and a column 109 from a lateral side of the shearing apparatus 100. Then, the basis plane 17 of the framework 10 is placed on the faces 103*a*' and 103*b*' of the bases 103*a* and 103*b*, and the position-controlling pin 113*a* on the lower side of the frame position controlling unit is inserted in the center hole 16*a* of the long-side frame 12*a*. Then, the connecting pole 133 is caused to slide forwardly with the handle 134 and then it is rotated, so that the clamping hook 131 is hooked on the short-side frames 11*a* and 11*b* of the framework 10. The connecting pole 133 is pulled up by moving the handle 134 upward or downward to an approximately perpendicular position and making the clamping cam 132 in contact with a lateral side of the cam pedestal 135, so that the framework 10 is press-fixed on the bases 103*a* and 103*b* with the clamping hook 131.

Furthermore, the procedure for releasing the framework from clamping is as follows: The handle 134 is moved rotationally upward or downward in a direction so as to loosen the clamping cam 132, and further is rotated around an axis of the connecting pole 133, so that the clamping hook 131 is released from hooking from the short-side frames 11*a* and 11*b*. The clamping hook 131 is recessed below the faces 103*a*' and 103*b*' by pulling up the handle 134 to the front, and the framework is removed.

In the method of fixing the framework 10 with a damper of such a configuration, the clamping force of fixing the framework can be kept constant all times, and generation of excessively large or small clamping forces of the framework 10 due to individual differences can be prevented. Thus, deformation of the framework 10 due to non-uniformity in the clamping force can be prevented, and generation of so-called return-distortion can be prevented. Furthermore, a large clamping force can be generated by operating a handle with a small force because of the principle of lever. Moreover, the framework 10 can be fixed as well as can be released from the fixing speedily with a simple structure.

By setting the framework 10 in the shearing apparatus 100 as described above, the center line of the circular arc curve of the upper and lower dies 105*a* and 105*b* can coincide with the center lines of the framework 10, that is, the center lines C of the circular arc curves of the end faces 13*a* and 13*b* shown in FIG. 2.

By moving downward the upper die 105*b* attached to the column 109 of the pressing apparatus 100 and shearing the end 14*a* of the long-side frame 12*a* of the framework 10 into a predetermined curved shape with the upper and lower dies 105*a* and 105*b*, formation of a curved shape of one side end face 13*a* is completed. By carrying out shearing, formation of a curve end face can be completed within a short time of only several seconds.

Next, the frame 1 is turned upside down, and a curved shape of an end face 13*b* of the long-side frame 12*b* on the other side is formed. The method of setting the framework 10 as well as the order and method of forming a curved shape are basically the same as the above. However, at this time, the position-controlling pin 113*b* on the upper side of the frame position controlling unit is inserted in the center hole 16*a* of the long-side frame 12*a*, in which a curved end face 13*a* has been already formed. That is, at both two times of shearing operations, position of the framework is controlled using a common basis point, namely, a center hole formed in the long-side frame on the same side (in the above example, the center hole 16*a*). Thus, even if there is a little deformation in a direction in a plane when assembling the framework 10 in a rectangular form (for example, in a case in which the long-side frames and the short-side frames are not connected at right angles, and the framework 10 is slightly distorted in the shape of a parallelogram), when the framework 10 is turned upside down after forming an end face on one side, the position of the center line C (see FIG. 2(C)) of the circular arc curve of the previously-formed end face in the horizontal direction can coincide with the position of the center line of the circular arc curve of the dies 105*a* and 105*b* in the horizontal direction. Thus, the center lines C of respective circular arc curves of the two end faces 13*a* and 13*b* as finally obtained can coincide. That is, center points of both circular arcs can coincide. As a result, a framework that maintains the cylindricity of a cylindrical surface formed by the end faces 105*a* and 105*b* can be manufactured.

Furthermore, the center hole 16*b* provided in the long-side frame 13*b* is used as needed when assembling the framework, but is not used for positioning in the shearing.

Although an example in which end faces on the screen side of long-side frames are sheared into a curved shape has been described in the above, the present invention is not limited to this example. The present invention also can be applied to the case in which end faces of long-side frames are sheared in a straight shape and a planar shadow mask is manufactured.

As mentioned above, according to the present invention, a basis plane for forming end faces of frames is produced by grinding bottom faces of a rectangular framework in free condition without applying any pressure to the framework, so that no return distortion is generated after the grinding, and a basis plane having a flatness with high precision of not more than one hundredth milimeter can be formed.

If such precision of the basis plane is maintained, when forming end faces on which a shadow mask is mounted, even if the basis plane is applied on an apparatus to be clamped with a necessary fixing force, no distortion is generated after the working. Thus, end faces with high precision can be formed by shearing using a conventional pressing machine with dies. Moreover, because shearing is employed, the working can be carried out rapidly in only several seconds.

Thus, because formation of end faces is enabled by a rapid shearing with high precision, expensive investment for introducing specialized working equipment can be reduced and equipment investment is minimized, and also working time is allowed to be at least 10 times more efficient than ever, so that significant effects can be obtained in terms of quality and productivity.

Furthermore, with respect to the grinding apparatus of a belt grinder system for a basis plane, by running two belt-like grinding papers closely on a bed, flat surfaces that are ground with a high flatness precision as mentioned above can be obtained, and a basis plane of a rectangular framework can be formed rapidly with high precision. Furthermore, the apparatus does not require any jig for fixing the rectangular framework other than a jig for preventing the rectangular framework from moving in the running direction of the grinding belt, so that cost of equipment can be reduced.

Furthermore, with respect to the shearing apparatus for forming, for example, a curved shape for the end faces of the frames on which a shadow mask is mounted, because positioning is carried out by inserting a position-controlling pin in one center hole provided in a rectangular framework at two times in the shearing operations, the center lines of the circular arc curves formed on two sides of the framework can coincide. Also, because the damper for fixing the framework uses a cam for clamping, the framework can be fixed by clamping with a predetermined clamping force, generation of return distortion due to non-uniformity of the clamping force can be prevented, and operations of setting and removing the framework can be simplified. Accordingly, the center line of the circular arc curve of the dies and the center lines of the circular arc curves on two sides of the framework can coincide with high precision, and the cylindricity of a cylindrical surface formed by end faces on two sides, on which a shadow mask is mounted, can be improved. Furthermore, the shearing apparatus of the present invention can be configured by setting necessary equipment in a conventional pressing machine. Moreover, shearing into a predetermined shape can be carried out instantly with the dies set in the apparatus.

Thus, apparatuses with stable qualities and improved production efficiencies can be provided at minimum costs.

Finally, it is understood that the invention may be embodied in other specific forms without departing from the spirit or essential characteristics thereof. The embodiments disclosed in this application are to be considered in all respects as illustrative and not restrictive, so that the scope of the invention being indicated by the appended claims rather than by the foregoing description, and all changes which come within the meaning and range of equivalency of the claims are intended to be embraced therein.

What is claimed is:

1. A method for manufacturing a framework for a shadow mask, which comprises cutting ends on a screen side of frames constituting two opposing sides of a framework in a predetermined shape by shearing, thereby obtaining end faces on which a shadow mask is stretched, wherein the framework is assembled in an approximately rectangular form.

2. A method for manufacturing a framework for a shadow mask, which comprises:

assembling a framework in an approximately rectangular form;

grinding a bottom face of the framework, thereby forming a basis plane;

cutting ends on a side opposite to the basis plane of frames constituting two opposing sides of the framework in a predetermined shape by shearing, thereby obtaining end faces on which a shadow mask is stretched.

3. The method according to claim 2, wherein when grinding the bottom face of the framework, the framework is placed on a grinding surface that is running, and the bottom face of the framework is ground while restricting movement of the framework in a running direction of the grinding surface.

4. The method according to claim 3, wherein the bottom face of the framework is ground while substantially no pressurizing force other than a self-weight of the framework is applied in a direction perpendicular to the grinding surface.

5. The method according to claim 2, wherein when the shearing is carried out, the framework is fixed using the basis plane as an application surface.

6. The method according to claim 1 or 2, wherein a basis point for positioning is provided at one point in the framework, and wherein when ends of the frames constituting two opposing sides are sheared respectively, positioning of each of the frames in a longitudinal direction is carried out using the basis point.

7. The method according to claim 2, wherein a basis point for positioning is provided at one point in the framework, and wherein when ends of the frames constituting two opposing sides are sheared respectively, positioning of each of the frames in a longitudinal direction is carried out using the basis point.

* * * * *